US005916098A

United States Patent [19]

Crelin

[11] Patent Number: 5,916,098

[45] Date of Patent: Jun. 29, 1999

[54] SWIMMING POOL STEPS

[76] Inventor: William Crelin, 44 Worthley St., Red Bank, N.J. 07701

[21] Appl. No.: 08/919,466

[22] Filed: Aug. 28, 1997

[51] Int. Cl.[6] ..... E02D 27/33; E04F 11/09

[52] U.S. Cl. ..... 52/169.7; 52/184; 52/190

[58] Field of Search ..... 52/169.7, 182, 52/184, 190

[56] References Cited

U.S. PATENT DOCUMENTS

| | | | |
|---|---|---|---|
| 3,236,012 | 2/1966 | Laven | 52/184 |
| 3,744,198 | 7/1973 | Boassy | 52/169.7 X |
| 3,755,981 | 9/1973 | West | 52/184 |
| 3,848,378 | 11/1974 | Witte | 52/169.7 X |
| 3,952,338 | 4/1976 | Troxclair | 52/184 X |
| 4,343,120 | 8/1982 | Witte | 52/169.7 X |
| 4,599,835 | 7/1986 | Rinke | 52/169.7 X |
| 4,873,802 | 10/1989 | Dahowski | 52/184 |

*Primary Examiner*—Christopher Kent
*Attorney, Agent, or Firm*—Mandel & Peslak, LLC.

[57] ABSTRACT

A replacement pool step for installation into the interior corner of a swimming pool is disclosed. The pool step is installed such that the vinyl liner of the pool does not cover the pool step but rather is installed in such a manner that it is sealed to the front of the pool step.

2 Claims, 1 Drawing Sheet

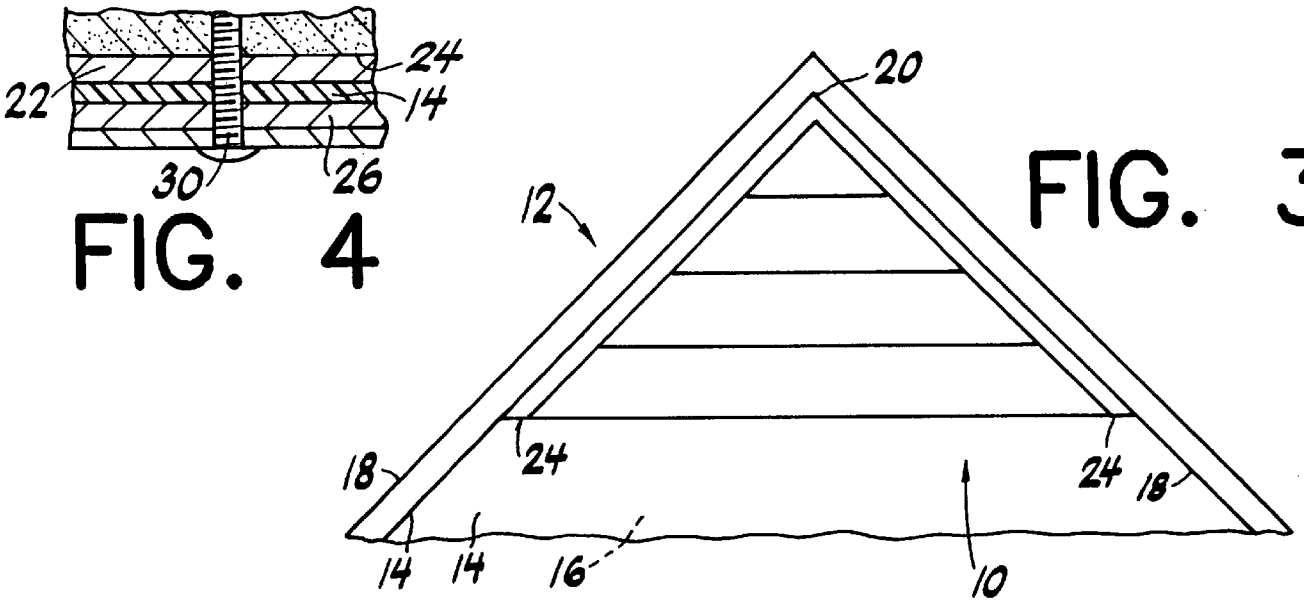
FIG. 3
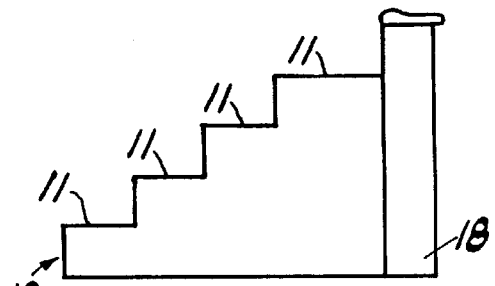
FIG. 2
FIG. 4
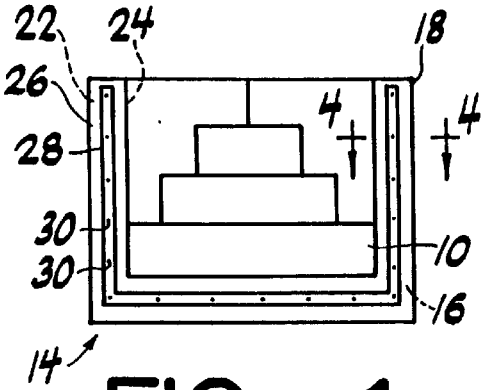
FIG. 1

SWIMMING POOL STEPS

BACKGROUND OF THE INVENTION

The present invention is directed to replacement steps used in an interior corner of a swimming pool. The steps can either be used to replace existing steps or to add steps to the corner of a pool where no steps currently exist.

The presently available replacement pool steps for installation into an interior corner of a swimming pool suffer from several disadvantages. First, the available pool steps are placed in the interior of the pool and then covered with the vinyl pool wall liner. In such an installation, the liner will not lay flat on the steps and may be subject to stretching and cracking. Second, when the steps themselves crack, it is necessary to remove the liner to reach the steps.

SUMMARY OF THE INVENTION

It is a primary object of the present invention to solve these problems with the prior art pool steps. In particular the present invention is directed to a pool step that is placed into a corner of the pool and the pool liner is installed under the edge of the step. A swimming pool, liner, and pool step combination comprising swimming pool comprising a plurality of walls and a floor with a plurality of interior corners between the plurality of walls, a vinyl liner installed over the plurality of pool walls and the floor, and an integrated pool step comprising a plurality of steps and a front surface wherein the integrated pool step is placed into an interior corner of the swimming pool, is attached rigidly to the pool walls and the vinyl liner is rigidly attached and sealed to the front surface of the pool step.

BRIEF DESCRIPTION OF THE DRAWINGS

FIG. 1 is a front plan view of a pool step according to the present invention.

FIG. 2 is a side plan view of the pool step shown in FIG. 1.

FIG. 3 is a plan view of the pool step according to the present invention installed in a swimming pool.

FIG. 4 is a section view of the pool step attachment to the pool.

DETAILED DESCRIPTION OF THE INVENTION

The replacement pool steps 10 of the present invention are illustrated in the figures. The pool steps 10 of the present embodiment are fabricated from fiberglass as an integrated unit. As shown in the Figures, the replacement pool step 10 contains a plurality of individual steps 11 and a front surface 24. The embodiment depicted in FIGS. 1 through 3 is made to be placed in a 90-degree pool corner. However, the present invention is not limited to 90-degree corners but may be used in corners either greater than or less than 90 degrees.

The pool 12 comprises a plurality of side walls 18 and a floor 16. As is well known to those of ordinary skill in the art, the plurality of side walls 18 will form a plurality of interior corners 20 of the pool 12. A vinyl liner 14 is normally installed to cover the floor 16 and side walls 18 of the pool 12.

The pool steps 10 are made to be dropped into one of the interior corners 20 of the pool 12. However, the pool steps 10, unlike prior replacement pool steps, are not covered by the vinyl liner 14 when placed into the pool 12.

Generally, the pool steps 10 are installed at the same time that a replacement vinyl liner 14 is installed. The first step in the procedure is to drain the pool and remove the old vinyl liner 14. The pool steps 10 are then placed into one of the plurality of interior corners 20 of the pool. Next, the new vinyl liner 14 is the placed into the pool 12 on top of the pool steps 10.

The pool steps 10 will be rigidly fixed from behind to the pool side walls 18 at corner 20. As is well known to those of ordinary skill in the art, the pool steps 10 can either be bolted to the side wall 18 or hung on a bracket type device from bolts inserted in the side wall 18.

At this point, the vinyl liner 14 will be cut out around the edge of the pool steps 10 as illustrated in FIG. 1. After the liner is cut out, a first gasket 22 will be inserted between the vinyl liner 14 and the front surface 24 of the pool steps 10. A second gasket 26 will be placed on the front of the vinyl liner 14. A face plate 28 will be installed in front of the second gasket 26. A plurality of screws 30 will be inserted through the face plate 28, the second gasket 26, the vinyl liner 14, the first gasket 22, and into the front surface 24 of the pool steps 10. After the vinyl liner 14 is fixed to the pool steps 10 in this manner, the vinyl liner 14 is then sealed to the pool steps 10 and the pool water will not travel out of the pool 12 through the pool steps 10.

An advantage of the present invention over prior pool steps that are covered by the vinyl liner 14 is evident. If the pool steps 10 crack or need to be replaced for some other reason, the vinyl liner 14 does not have to be entirely removed prior to replacement of the pool steps 10 since the vinyl liner 14 does not cover the pool steps 10 of the present invention. Further, since the pool steps 10 are not covered by the vinyl liner 14, the problems with prior pool steps of the liner not laying flat on the steps with the consequent stretching and cracking of the liner are eliminated with the pool step 10 of the present invention.

Those of ordinary skill in the art will recognize that the embodiments just described merely illustrate the principles of the present invention. Many modifications may be made thereto without departing from the spirit and scope of the invention as set forth in the following claims.

What is claimed is:

1. A swimming pool, liner, and pool step combination comprising:

a) a swimming pool comprising a plurality of walls and a floor with a plurality of interior corners whererin each said interior corner is formed by the intersection of two of the plurality of walls;

b) a vinyl liner installed over the plurality of pool walls and the floor; and c) an integrated pool step comprising a plurality of steps, a top surface of the plurality of steps, and a front surface wherein the integrated pool step is placed into an interior corner of the swimming pool, is attached rigidly to the pool walls and the vinyl liner is rigidly attached and sealed to the front surface of the pool step wherein the vinyl liner does not cover the top surface of the plurality of steps.

2. The combination of claim 1 wherein the corner of the swimming pool into which the integrated pool step is placed is a ninety-degree corner.

* * * * *